US005451978A

United States Patent [19]

Harju

[11] Patent Number: 5,451,978

[45] Date of Patent: Sep. 19, 1995

[54] METHOD AND DEVICE FOR DRIVING AN ELECTROLUMINESCENCE MATRIX DISPLAY

[75] Inventor: Terho Harju, Lohja as., Finland

[73] Assignee: Planar International Oy Ltd., Espoo, Finland

[21] Appl. No.: 45,163

[22] Filed: Apr. 12, 1993

[30] Foreign Application Priority Data

May 15, 1992 [FI] Finland ..... 922215

[51] Int. Cl.[6] ..... G09G 3/10

[52] U.S. Cl. ..... 345/78; 345/79; 345/212

[58] Field of Search ..... 315/169.3; 340/784, 340/781, 793, 760, 825.81; 345/54, 55, 76, 77, 98, 147, 78, 79, 212

[56] References Cited

U.S. PATENT DOCUMENTS

| | | | |
|---|---|---|---|
| 4,642,24 | 2/1987 | Eaton et al. | 340/781 |
| 3,972,040 | 7/1976 | Hilsum et al. | 345/55 |
| 4,152,626 | 5/1979 | Hatta et al. | 340/781 |
| 4,443,741 | 4/1984 | Tanaka et al. . | |
| 4,456,909 | 6/1984 | Takahara et al. | 340/781 |
| 4,554,539 | 11/1985 | Graves | 315/169.3 |
| 4,559,535 | 12/1985 | Watkins et al. . | |
| 4,626,072 | 12/1986 | Clerc et al. . | |
| 4,949,012 | 8/1990 | Isaka et al. | 340/781 |
| 5,008,657 | 4/1991 | Hanson et al. | 340/781 |

FOREIGN PATENT DOCUMENTS

| | | | |
|---|---|---|---|
| 0345399 | 12/1989 | European Pat. Off. | 345/77 |
| 1-307797 | 12/1989 | Japan . | |
| 2-15295 | 1/1990 | Japan . | |
| 2149182 | 6/1985 | United Kingdom | 340/781 |

OTHER PUBLICATIONS

Paolo Maltese, "Cross Modulation and Disuniformity Reduction in the Addressing of Passive Matrix Displays", Eurodisplay 84, pp. 15–20.

*Primary Examiner*—Richard Hjerpe
*Assistant Examiner*—Steve Saras
*Attorney, Agent, or Firm*—Lowe, Price, LeBlanc & Becker

[57] ABSTRACT

The invention concerns a method and device for driving an electroluminescence matrix display. According to the method succeeding images are formed on the display (1), whereby to form one image all the row electrodes (r1–r6) of the display are scanned through one by one with a constant voltage, and a column voltage corresponding to the desired instantaneous combination of luminance levels is formed for the column electrodes (c1–c2) in synchronism with the scanning of the row electrodes (r1–r6). According to the invention a voltage corresponding to the average modulation voltage (AV) of the column electrodes (c1–c6) is connected to at least a part of the non-selected row electrodes (r1–r6) to capacitively raise the column electrodes (c1–c6) by the amount of the average modulation level, and only the required column electrodes (c1–c6) are driven to the difference voltage in reference to the average modulation voltage (AV).

11 Claims, 4 Drawing Sheets

METHOD AND DEVICE FOR DRIVING AN ELECTROLUMINESCENCE MATRIX DISPLAY

The object of the present invention is a method for driving an electroluminescence matrix display.

Another object of the invention is also a device for driving an electroluminescence matrix display.

According to known techniques driving of an electroluminescence display is in most commercially available solutions implemented as an ON/OFF solution without a more accurate grey scale drive.

In U.S. Pat. No. 4,559,535 as well as Japanese patents JP 02-15295 and JP 01-307797 implementation of grey scales in electroluminescence displays is described. The solution according to the US publication is not especially good as for its bit efficiency. The Japanese publications describe pulse-width modulation methods, the problems related therewith to be described below.

Circuits based on amplitude modulation and capable of forming grey scales (Supertex HV08 and HV38) have been used, but in practical solutions the general luminance level was found to excessively affect the grey scales of an individual pixel. Correction of this basic solution to a better functioning solution proved out to be expensive and, in addition, the necessary supplementary circuits would have significantly increased the power consumption.

Another modulation method that has been used, the pulse-width modulation (PWM), presents similar problems as the aforementioned amplitude modulation: unstability of grey scales because of changing drive pattern, as well as problems of power consumption.

In addition, the column driver circuits of the solutions discussed above are complicated and expensive to manufacture.

It is the purpose of this invention to remove the deficiencies of the techniques described above and to provide a method of quite a novel type for driving an electro-luminescence matrix display.

The invention is based on the concept that to at least a part of non-selected row electrodes is connected a voltage corresponding to the average modulation voltage to raise the column electrodes capacitively by the amount of the average modulation level, and only the required column electrodes are driven by discharging or charging these from the average voltage.

In an advantageous embodiment of the invention the instantaneus average column voltage is measured from the display, by which voltage the timing of the switches of the columns is controlled by way of feedback.

With the invention remarkable advantages can be attained.

The column drive circuit can be made very simple, and due to the feedback the picture quality, especially the stability of grey scales, is significantly improved.

The invention will be further discussed with the aid of the examples of embodiments according to the attached figures.

Figure 4:
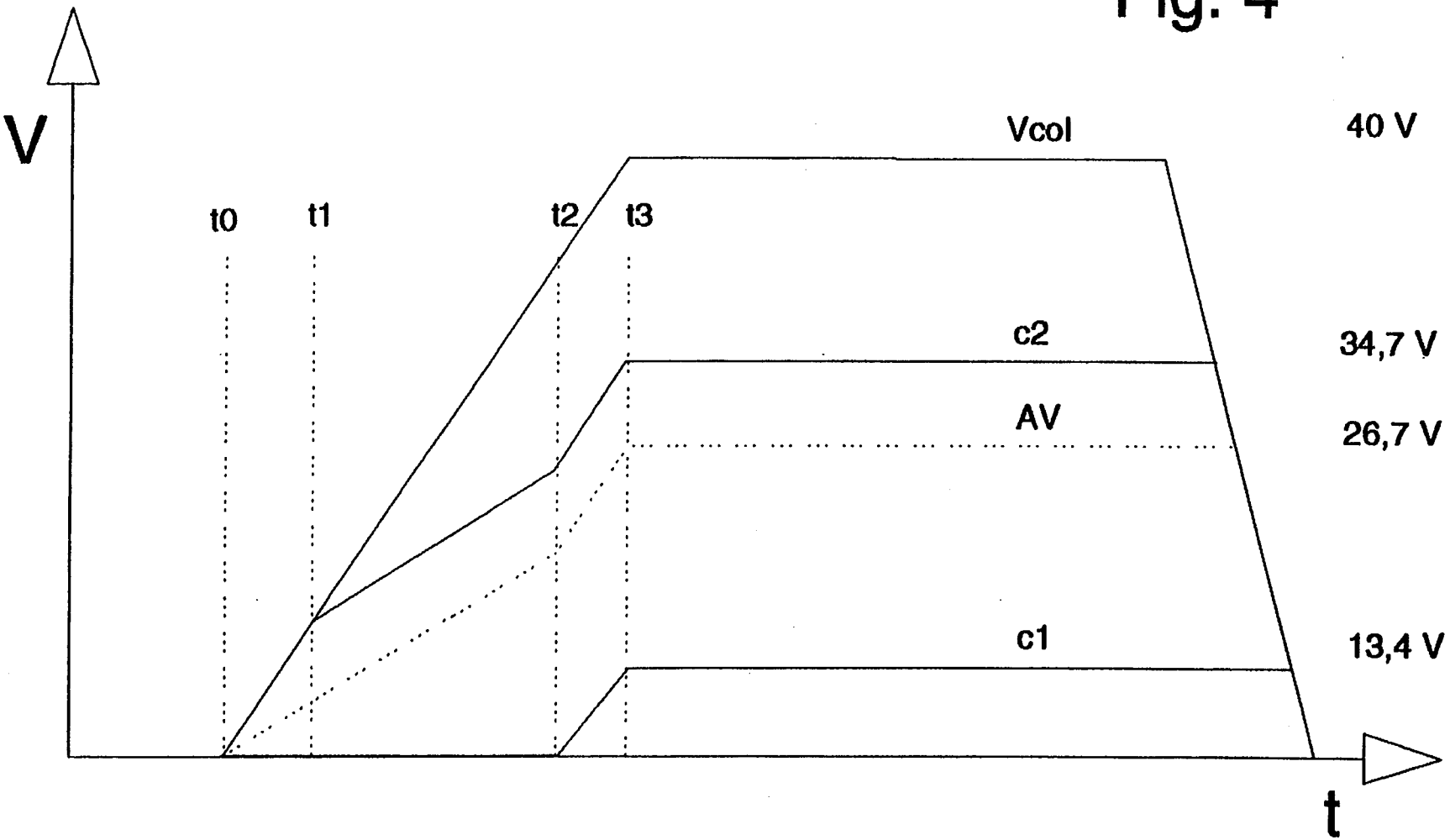

FIG. 4 graphically shows waveforms of column voltages for the solution according to the invention.

Figure 1:
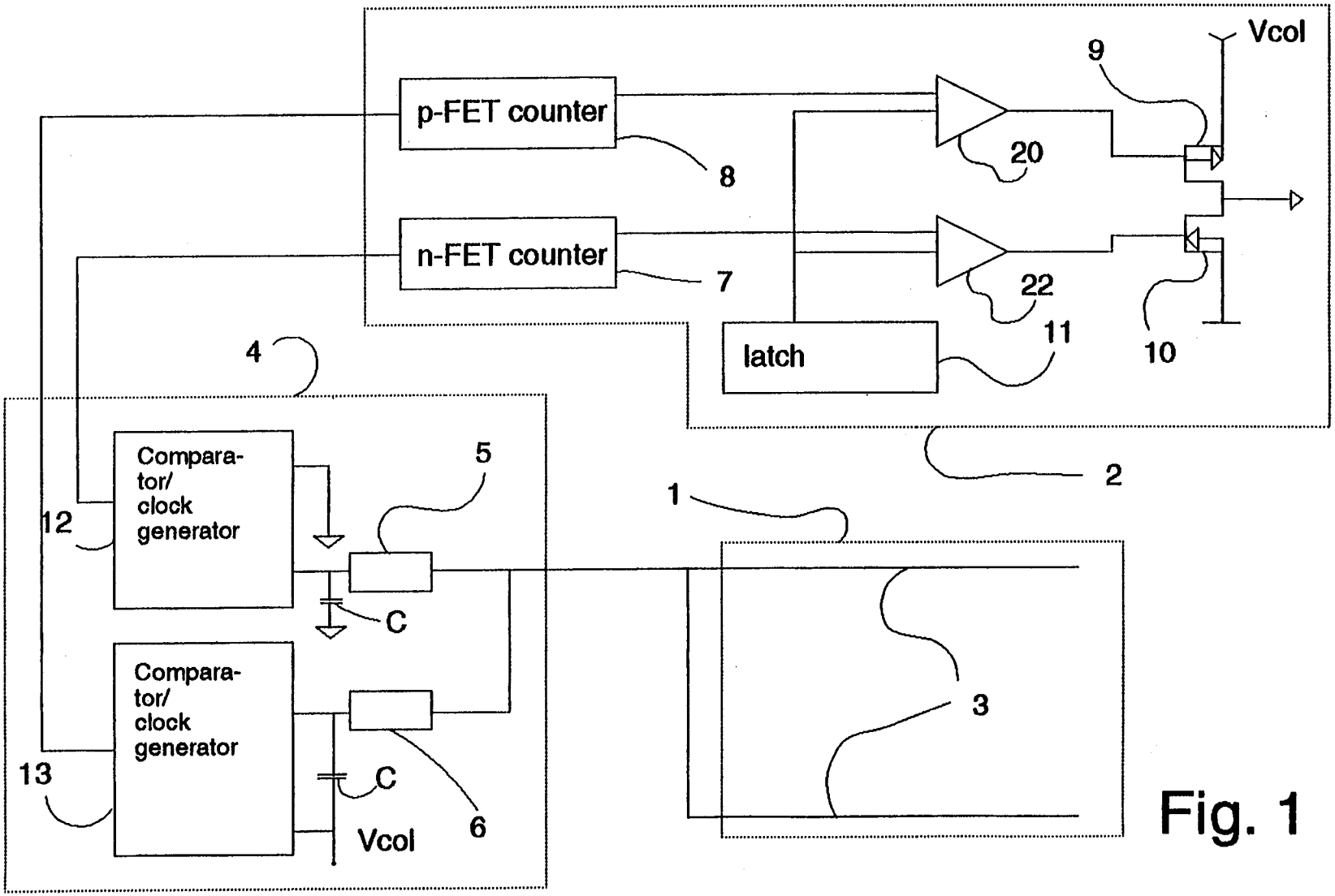
FIG. 1 shows one driver solution according to the invention in a block diagram form.

According to FIG. 1 the device comprises three basic blocks: a display 1, a feedback block 4, and a column driver block 2. Blocks 2 and 4 are, naturally, common to the display as a whole. The latch of the column drivers block, comparators 20 and 22, as well as the FET's are column-specific components. At the upper and lower edges of the display 1 there are formed additional sense rows 3, which are used for sensing the actual column voltage. To make the example more concrete we suppose in this case that the modulation voltage range is 0 . . . +40 V and the number of grey levels is 16. Thus the voltage corresponding to one grey level is 40/15 V=2.67 V. To describe the principle of this invention one may think of a theoretical situation, where the FET's 9 and 10 used as switches are in non-conducting state and all column electrodes are floating. One can then capacitively drive the column electrodes through the nonselected row electrodes, whereat all the grey scales of the display can be scanned through without a column driver. In the illustrated example all the pixels in one row would naturally show a similar luminance.

In actual display situation the initial value in the counters 8 and 7 is the calculated average value of the column voltage of the selected row. This information is obtained from a data processing block (not shown) by calculating per row the sum of the input serial video data and dividing it by the number of columns. In this description this calculated average per row is designated by the symbol FAV, which corresponds to the final value of the instantaneous average modulation voltage designated by the symbol AV. In the path of the signal coming from the sense rows 3 there are arranged resistors 5 and 6, which correspond to the average column resistance. In case of the comparator 12, after the resistance 5 there is arranged a capacitor C against ground, and in case of the comparator 13 against the voltage Vcol, the waveform of which voltage is during each display period a similar RAMP voltage to illustrate the principle of the invention. The voltage obtained from the sense rows 3 is accordingly RC filtered (low-pass filtered) before passing it to the comparators 12 or 13.

By way of illustration it is supposed that the numbers 0–15 correspond to the grey levels so that zero corresponds to a dark pixel and 15 to the brightest pixel. Similarly it is supposed that the row select pulse is negative, whereat +40 V modulation voltage corresponds to the brightest level. The average grey level of a row is supposed to be the value 10, which corresponds to the voltage 10 * 2.67 V=26.7 V.

a) The desired grey level is 13, which is stored in the latch 11 in numerical form. The desired grey level is consequently higher than the initial value (10) in the counter 8. Therefore the FET 9 controlled by the comparator 20 is in conducting state, and the RAMP voltage Vcol is passed directly to the column. However, a rising, signal is received from the electrodes of the display 1 to the input of the comparator 13, and with each grey level step (2.67 V) a pulse is given to the counter 8, which pulse increments the value in the counter 8 by one. Hence, after passing over three grey levels the value in the counter 8 corresponds to the value in the latch 11, and the FET 9 will go to the non-conducting state. At this time the column voltage is 3 * 2.67 V greater than its instantaneous measured average voltage AV. The value in the counter 7 has all the time been below the value in the latch 11, and because the counter 7 is a down-counter, the FET 10 driven by the comparator 22 has all the time been in the non-conducting state. Hence, after three clock signals of the comparator 13 the column will be floating and following the voltage AV of the row electrodes. When AV rises to its final value FAV (26.7 V), the column voltage rises to the value 3 * 2.67+26.7 V=34.7 V.

b) Let us suppose that the desired grey level is 5. According to the preceding example the FET 9 has all the time been in the non-conducting state. The FET 10 is conducting instead, because the initial value (10) of the counter 7 is greater than the contents (5) of the latch 11. In the way discussed above, the comparator 12 now sends clock pulses to the counter 7 after a voltage change corresponding to each passing over of each grey level, and consequently after five clock pulses the FET 10 goes to the non-conducting state, and the column electrode starts to follow the drive voltage of the row electrodes. For the final voltage of the column we get 26.7 V−5 * 2.67 V=13.4 V.

Figure 2:
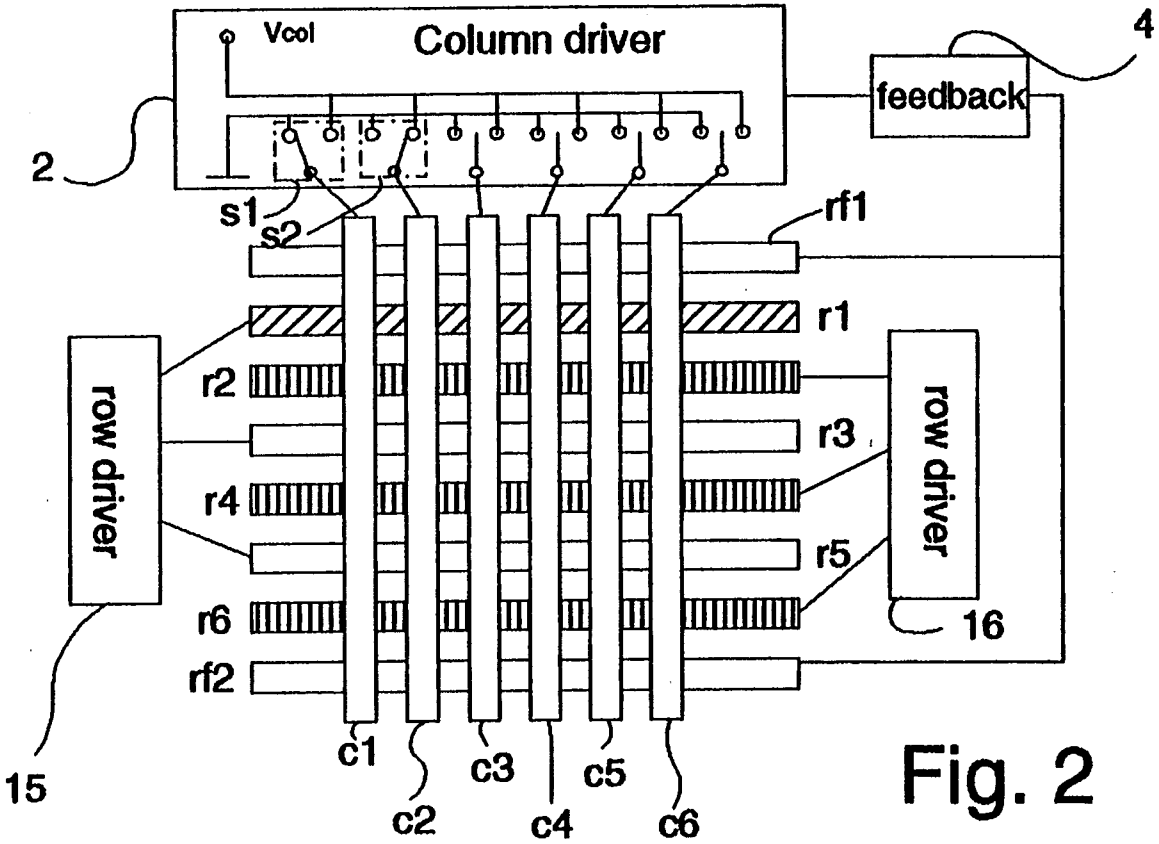
FIG. 2 shows a 6×6 display matrix according to the invention in a simplified principle diagram in one display drive situation.

In the solution according to FIG. 2 the display consists of a 6×6 matrix, where to form an image all the rows r1–r6 are scanned through one by one from the top down, and the luminance level of an individual pixel in each row is determined by the voltages of the columns c1–c6. In the display matrix the column driver 2 is shown simplified as operating with switches, of which, for instance, s1 and s2 control the voltages of the columns c1 and c2. The columns c3–c6 are connected floating by their own switches. All the columns c1–c6 are connected to the column driver circuit 2. In the solution of the Figure there are two row drivers, a driver 15 for odd rows r1, r3 and r5, and a driver 16 for even rows r2, r4 and r6. Above the topmost display row r 1 there is, in addition, the first sense row rf1 and, respectively, below the lowest display row r6 there is another sense row rf2, with the column driver to be controlled with the aid of the feedback block 4 on basis of the column voltage data obtained thereform. In the solution of the Figure the selected row is r1. The other odd rows r3 and r5 are floating. The even rows r2, r4 and r6 are connected to the average column voltage AV corresponding to the row r1 with the row driver 16. This voltage raises the voltage of the capacitively floating columns c3–c6. The column c1 is connected to the ground potential to obtain a luminance level lower than the average for the pixel formed by the row r1 and the column c1. The column c2 is correspondingly connected to the voltage Vcol to reach a luminance level higher than the average for the pixel formed by the row r1 and the column c2.

Figure 3:
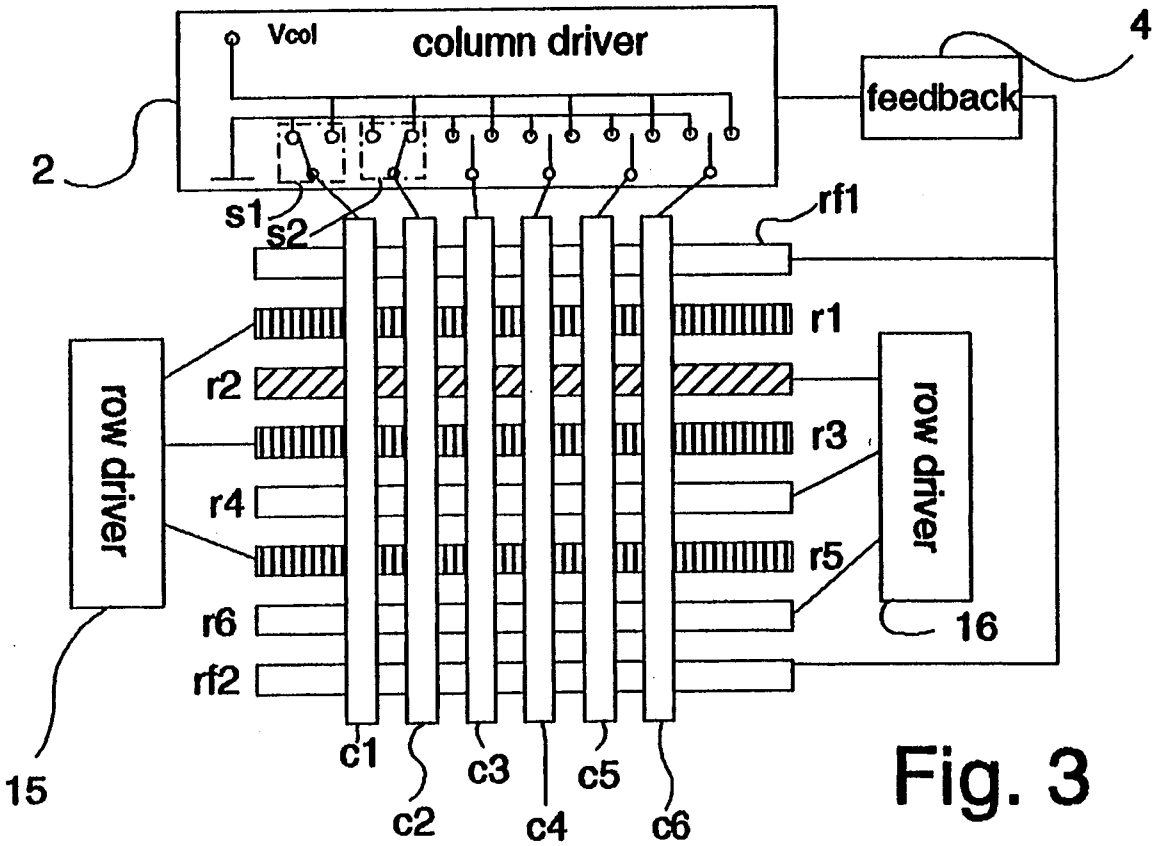
FIG. 3 shows the display matrix of FIG. 2 in another display drive situation.

In FIG. 3 in the solution according to FIG. 2 one has advanced by one row when driving the display. Hence, the row driver 16 has selected the row r2, and the other rows r4 and r6 driven by the driver 16 are floating. The driver 15 for the odd rows has in turn connected the rows r1, r3 and r5 to the voltage AV, which corresponds to the average column voltage corresponding to row r2.

FIG. 4 shows typical waveforms of the column voltage. Although the graph is not to scale and not fully corresponds to Examples a) and b) given in connection with FIG. 1, reference will here be made thereto. The Example of FIG. 2 will also be interpreted with the aid of the waveforms of FIG. 4.

Column c1, FIG. 2:

The display period begins at time t0, and up to time t2 the switch s1 in FIG. 2 is connected to the ground potential, and at time t2 the switch is released, whereafter the column c1 is floating and begins to follow the control voltage AV coming through the even rows r2, r4 and r6 with the amount of the charged difference voltage (5 * 2.67 V=13.4 V) below it.

Column c1, FIG. 1:

According to Example b) the column c1 is kept at the ground potential, until the n-FET counter 7 counts down the value corresponding to the AV voltage with pulses coming from the feedback circuit 4, whereby the counter at time t2 reaches the value stored in the latch 11. Thereafter column c1 is left floating, and the column finally reaches the voltage 26.7 V−5 * 2.67=13.4 V at time t3.

Column c2, FIG. 2:

Up to time t1 the switch s2 in FIG. 2 is connected to the voltage Vcol. At time t1 the switch is released and column c2 is floating and begins to follow the control voltage AV coming through the even rows r2, r4 and r6, above it.

Column c2, FIG. 1:

According to Example a) the column c2 is kept at the voltage Vcol, until the p-FET counter 8 counts up the value corresponding to the AV voltage with pulses coming from the feedback circuit 4, whereby the counter at time t1 reaches the value stored in the latch 11. Thereafter the column c1 is left floating, and the column finally reaches the voltage 26.7 V+3 * 2.67=34.7 V.

In theory, the feedback can also be substituted by calculating the waveform of the voltage AV in advance from the column drive voltage information. This solution is, however, expensive and difficult to implement as for device techniques and drive techniques, since the solution should compensate for the effect of the resistance of the column electrode on the difference voltage to be charged and allow Vcol voltages with changing waveforms to save power.

I claim:

1. A method for driving an electroluminescence matrix display, whereby succeeding images are formed on the display (1), and to form one image all the row electrodes (r1–r6) of the display are scanned through one by one with a constant voltage, and a column voltage corresponding to the desired instantaneus combination of luminance levels for each row (r1–r6) is formed for column electrodes (c1–c2) in synchronism with the scanning of the row electrodes, said column voltage being an average modulation voltage, characterized in that a voltage corresponding to the average modulation voltage (AV) of the column electrodes (c1–c6) is connected to at least one of non-selected row electrodes (r1–r6) to capacitively raise the column electrodes (c1–c6) by the amount of the average modulation voltage, and only the required column electrodes (c1–c6) are driven to the difference voltage in reference to the average modulation voltage (AV).

2. The method according to claim 1, characterized in that the voltage of the column electrodes (c1–c6) is sensed by at least one sense electrode (rf1, rf2) extending parallel to the row electrodes (r1–r6), and the sensed voltage is used for driving the column electrodes (c1–c6).

3. The method according to claim 2, characterized in that the column electrodes (c1–c6) are driven in the beginning of a display period, and driving is stopped, when information about a sufficient difference voltage has been obtained through the sense electrodes (3) and a feedback circuit (4).

4. A device for driving an electroluminescence matrix display comprising:

an electroluminescence display (1) comprising column electrodes (c1–c6) and row electrodes (r1–r6), driver means (2) for the column electrodes (c1–c6), and driver means (15, 16) for the row electrodes (r1–r6), characterized by means for determining the average column voltage (AV) per row, the driver means (15, 16) for the row electrodes (r1–r6) comprise means by which at least one of non-selected rows (r1–r6) are connectable to the average column voltage (AV), to capacitively raise the column electrodes by the amount of the average column voltage, and the driver means (2) for the column electrodes (c1–c6) comprise switch means (s1–s2) by which the column electrodes (c1–c6) are connected either to the ground potential or to a column drive voltage (Vcol) thereby driving one or more selected column electrodes to a driven voltage different than the average column voltage while non-selected column electrodes are in a floating state and (ii) separately disconnected from said ground potential or said column drive voltage thereby placing said one or more selected column electrode in a floating state at said driven voltage.

5. The device according to claim 4, characterized in that the device comprises at least one sense electrode (3) and a feedback means (4) connected thereto for controlling the switch means (s1, s2) of the column electrodes on basis of a column voltage sensed by the sense electrode (3).

6. The device according to claim 4, characterized in that two sense electrodes (3) are disposed parallel to the row electrodes (r1–r6) at upper and lower edges of the display.

7. The device according to claim 4, further comprising at least one sense electrode and a feedback means connected thereto for separately disconnecting the switch means of the one or more selected column electrodes to place said one or more selected column electrodes in the floating state at the driven voltage.

8. A device for driving an electroluminescence matrix display comprising:

an electroluminescence display having column electrodes and row electrodes;

driver means for the column electrodes; and driver means for the row electrodes, including means (i) for determining an average column voltage per row and (ii) for connecting at least one or non-selected rows to the average column voltage to capacitively raise the column electrodes by the amount of the average column voltage, wherein the driver means for the column electrodes include switch means by which the column electrodes, in a first state, float between a ground potential and column drive voltage and in a second state connect to the ground potential and in a third state connect to the column drive voltage wherein, column electrodes in said second or third state are driven to a voltage different than the average column voltage.

9. A method for driving an electroluminescence matrix display having row electrodes and column electrodes comprising the steps of:

forming successive images on the display;

scanning all the row electrodes of the display one by one with a constant voltage to form an image;

forming a column voltage for the column electrodes, corresponding to a desired instantaneous combination of luminance levels for each row of row electrodes, in synchronism with the scanning of the row electrodes, said column voltage being an average modulation voltage;

connecting a voltage corresponding to said average modulation voltage of the column electrodes to at least one of non-selected row electrodes to capacitively raise the column electrodes by the amount of the average modulation voltage, driving only the required column electrodes to a difference voltage in reference to the average modulation voltage, and placing said driven column electrodes in a floating state after said difference voltage has been attained.

10. The method according to claim 9, further comprising the step of sensing the voltage of the column electrodes by at least one sense electrode extending parallel to the row electrodes; and using the sensed voltage for driving the column electrodes.

11. The method according to claim 9, wherein the column electrodes are driven in the beginning of a display period, and further comprising the step of:

stopping the driving after information indicative of a sufficient difference voltage has been obtained through sense electrodes and a feedback circuit.

* * * * *